United States Patent [19]

Williams et al.

[11] 4,422,925

[45] Dec. 27, 1983

[54] CATALYTIC CRACKING

[75] Inventors: Dale Williams; John C. Strickland, both of Houston, Tex.

[73] Assignee: Texaco Inc., White Plains, N.Y.

[21] Appl. No.: 335,303

[22] Filed: Dec. 28, 1981

[51] Int. Cl.[3] ..... C10G 11/05

[52] U.S. Cl. ..... 208/75; 208/74; 208/156; 208/164; 208/120

[58] Field of Search ..... 208/75, 120, 78, 164, 208/74, 156; 585/648, 651, 653

[56] References Cited

U.S. PATENT DOCUMENTS

| | | | |
|---|---|---|---|
| 3,042,196 | 7/1962 | Payton et al. | 203/164 X |
| 3,617,496 | 11/1971 | Bryson et al. | 208/80 |
| 3,617,497 | 11/1971 | Bryson et al. | 208/80 |
| 3,661,799 | 5/1972 | Cartmell | 208/164 X |
| 3,706,654 | 12/1972 | Bryson et al. | 208/164 X |
| 3,849,291 | 11/1974 | Owen | 208/78 |
| 3,894,932 | 7/1975 | Owen | 208/78 |
| 4,051,013 | 9/1977 | Strother | 208/78 |
| 4,172,816 | 10/1979 | Pop et al. | 585/613 X |

OTHER PUBLICATIONS

Shankland and Schmitkons "Determination of Activity and Selectivity of Cracking Catalyst" Proc. API 27(III) 1947, pp. 57–77.

*Primary Examiner*—Delbert E. Gantz
*Assistant Examiner*—George Schmitkons
*Attorney, Agent, or Firm*—Carl G. Ries; Robert A. Kulason; Robert Knox, Jr.

[57] ABSTRACT

A fluid catalytic cracking process and apparatus in which a plurality of hydrocarbon feedstocks including at least one normally gaseous paraffinic hydrocarbon feedstock and at least one normally liquid hydrocarbon feedstock are subjected to cracking reaction conditions in a common transport type reaction zone in the presence of a zeolite cracking catalyst. Fresh hot regenerated catalyst is first contacted with a normally gaseous paraffinic hydrocarbon under dehydrogenation reaction conditions effecting conversion to normally gaseous olefins, and fresh normally liquid cracking charge stock is contacted in the reaction zone under cracking reaction conditions with the gaseous paraffinic and olefinic hydrocarbons.

11 Claims, 1 Drawing Figure

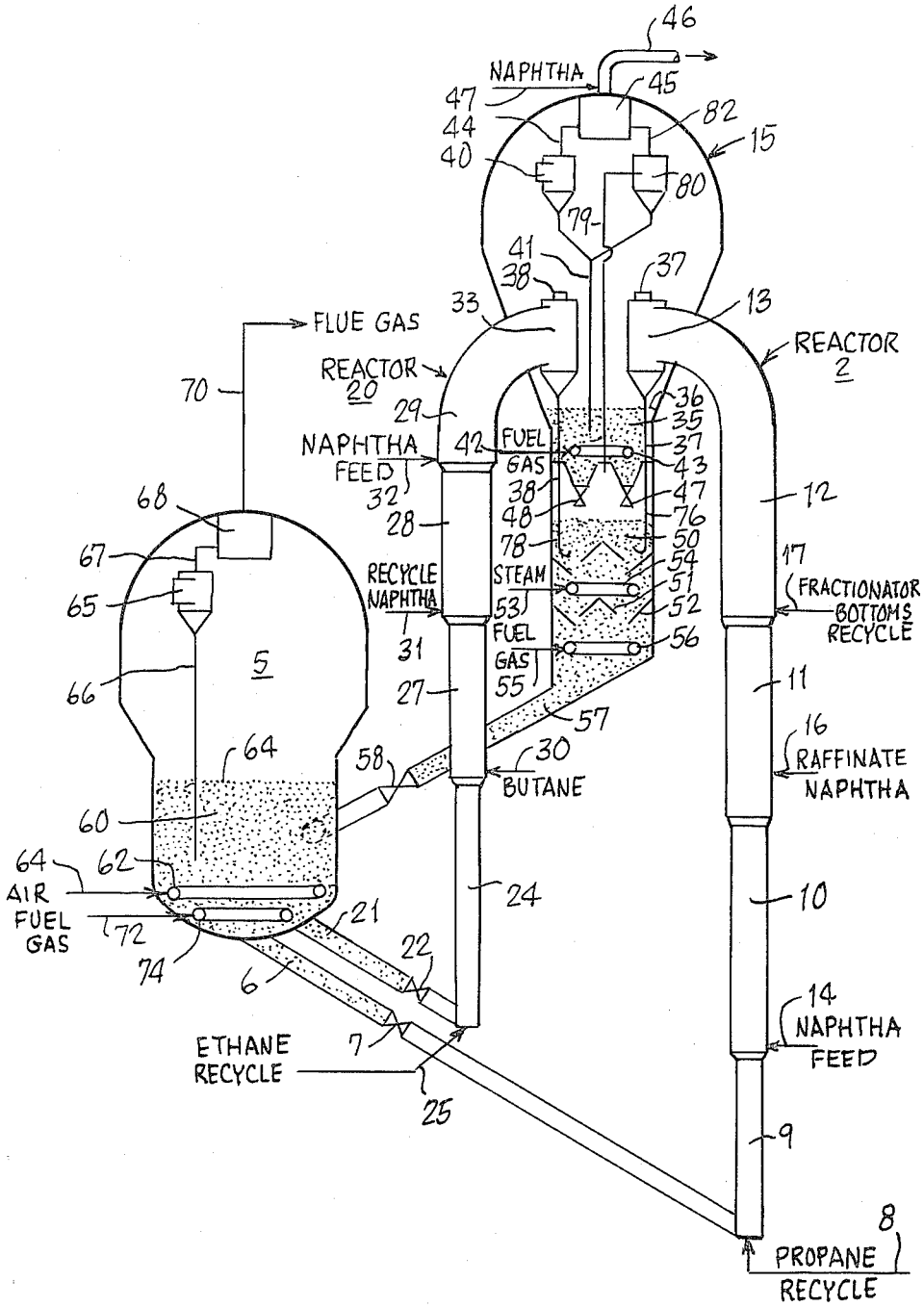
NAPHTHA
FLUE GAS
REACTOR 20
REACTOR 2
NAPHTHA FEED
FUEL GAS
RECYCLE NAPHTHA
STEAM
FUEL GAS
FRACTIONATOR BOTTOMS RECYCLE
RAFFINATE NAPHTHA
BUTANE
AIR
FUEL GAS
ETHANE RECYCLE
NAPHTHA FEED
PROPANE RECYCLE

CATALYTIC CRACKING

This invention relates to a process and apparatus for fluid catalytic cracking of petroleum feedstocks to produce motor fuel components and simultaneously produce high yields of light olefins. In one of its more specific aspects, this invention relates to a short contact time riser reactor type catalytic cracking process wherein both normally gaseous and normally liquid petroleum charge stocks are contacted with cracking catalyst in a common riser reactor. Suitably normally gaseous hydrocarbon charge stocks include ethane, propane, butane, isobutane, and mixtures thereof including methane, methane-rich gases, e.g. refinery fuel gas, absorber off-gas, and the like.

A number of fluid catalytic cracking (FCC) processes are known in the art. In the older processes, catalytic cracking is carried out by contacting the hydrocarbon charge stock with a large mass of particulate cracking catalyst in a dense phase fluidized bed for a relatively long period of time, e.g. 10 seconds or longer. More recently, improved commercial catalytic cracking catalysts have been developed which are highly active and possess increased selectivity for conversion of selected hydrocarbon charge stocks to desired products. With such active catalysts it is now generally preferable to conduct catalytic cracking reactions in a dilute phase transport type reaction system with a relatively short period of contact between the catalyst and the hydrocarbon feedstock, e.g. 0.2 to 10 seconds.

The control of short contact times optimum for the newer catalysts in dense phase fluidized bed reactors is generally not feasible. Consequently, catalytic cracking systems have been developed in which the primary cracking reaction is carried out in a transfer line reactor or riser reactor. In such systems, the catalyst is dispersed in the hydrocarbon feedstock and passed through an elongated reaction zone at relatively high velocity. In these transport reactor systems, vaporized hydrocarbon cracking feedstock acts as a carrier for the catalyst. In a typical upflow riser reactor, the hydrocarbon vapors move with sufficient velocity as to maintain the catalyst particles in suspension with a minimum of back mixing of the catalyst particles with the gaseous carrier. Thus development of improved fluid catalytic cracking catalysts has led to the development and utilization of reactors in which the reaction is carried out with the solid catalyst particles in a dilute phase condition with the catalyst dispersed or suspended in hydrocarbon vapors undergoing reaction, e.g., cracking.

The cracking reactions are conveniently carried out in catalyst risers or transfer lines wherein the catalyst is moved from one vessel to another by the hydrocarbon vapors. Such reactors have become known in the art as transport reactors, riser reactors, or transfer line reactors. The catalyst and hydrocarbon mixture passes from the transport reactor into a separation zone in which hydrocarbon vapors are separated from the catalyst. The catalyst particles are then passed into a second separation zone, usually a dense phase fluidized bed stripping zone wherein further separation of hydrocarbons from the catalyst takes place by stripping the catalyst with steam. After separation of hydrocarbons from the catalyst, the catalyst finally is introduced into a regeneration zone where carbonaceous residues are removed by burning with air or other oxygen-containing gas. After regeneration, hot catalyst from the regeneration zone is reintroduced into the transport reactor into contact with fresh hydrocarbon feed. A number of such reactor configurations are known in the art, as illustrated, for example, in U.S. Pat. Nos. 3,394,076, 3,835,029 and 3,894,931.

In accordance with this invention, there is provided an improved process for catalytically cracking a plurality of hydrocarbon feedstocks in a short contact time reaction zone, or transfer line reactor in which normally gaseous hydrocarbons and normally liquid hydrocarbons are catalytically cracked in the same reactor with the result that both light olefins and motor fuel stocks are obtained. The products of the process of this invention contain a relatively greater proportion of olefins suitable for alkylation or other petrochemical processes than are obtained from transfer line cracking of liquid feedstocks in the absence of the normally gaseous hydrocarbons.

According to this invention, there is provided an improved process for catalytic conversion of a hydrocarbon feedstock to light olefins in a fluid catalytic cracking unit comprising a riser reactor and a catalyst regenerator. A normally gaseous hydrocarbon feedstock selected from the group consisting of ethane, propane, butane, isobutane and mixtures thereof is first contacted with freshly regenerated zeolite cracking catalyst at a temperature in the range of 1250° F. to 1350° F. for a period of time within the range of from about 0.05 to about 1 second. The mixture of catalyst and reaction products is then contacted with a hydrocarbon feedstock suitable for catalytic cracking, such as virgin naphtha, virgin gas oil, light cycle gas oil, or heavy cycle gas oil. The charge stocks, both normally gaseous and normally liquid hydrocarbon feedstocks, are preferably preheated to a temperature in the range of 900° to 1000° F. The freshly regenerated zeolite type cracking catalyst is preferably at a temperature in the range of 1375° to 1450° F. with a catalyst-to-hydrocarbon feed weight ratio in the first section of the reactor within the range of from about 15 to 25. The temperature and catalyst-to-oil ratio decrease progressively in subsequent sections of the reactor as the heavier hydrocarbon charge stocks are introduced into the reactor. The process may be carried out at a pressure in the range of 15 to 150 psig, preferably 90 to 120 psig.

It is known from U.S. Pat. Nos. 3,835,029 and 4,172,816 that normally liquid hydrocarbons may be cracked at a temperature in the range of 538° C. (1000° F.) to 750° C. (1382° F.) in the presence of aluminosilicate contact catalysts to yield light olefins. The production of light olefins from normally gaseous feedstocks is conventionally accomplished by pyrolysis, usually in the presence of steam.

The FIGURE is a diagrammatic representation of the process flow and of apparatus illustrating one or more preferred embodiments of the process and apparatus of this invention.

With reference to the drawing, a suitable fresh hydrocarbon charge stock, for example, a virgin naphtha, is supplied to a midsection of a riser reactor 2 of a fluid catalytic cracking unit (FCCU) through line 14. The fresh charge stock contacts equilibrium molecular sieve zeolite cracking catalyst and reaction products from other sections of the riser reactor 2, as described hereinafter.

Hot regenerated catalyst is supplied to riser reactor 2 from regenerator 5 through standpipe 6 at a rate controlled by slide valve 7. The regenerated catalyst, which preferably has a carbon content less than 0.3 weight percent, is withdrawn from the regenerator 5 at a temperature in the range of from about 1275° F. to about 1450° F. and introduced into the lowermost section 9 of riser reactor 2. A normally gaseous hydrocarbon charge stock is introduced into the lowermost section 9 of riser reactor 2 through line 8. The hydrocarbon charge stock supplied through line 8 may be a propane recycle stream, i.e., a $C_3$ or propane rich fraction obtained from the reaction products of the FCCU, preferably preheated to a temperature in the range of 900° to 1000° F. The initial reaction temperature in section 9 is preferably in the range of 1200° to 1375° F. with a residence time in the range of 0.05 to 1 second, preferably 0.2 to 0.5 second.

The resulting mixture of gasiform hydrocarbons and catalyst suspended therein passes upwardly through section 8 of riser reactor 2, suitably at an average superficial gas velocity within the range from about 40 to about 60 feet per second and at a temperature of about 1300° F. Cracking, dehydrogenation and reforming of the $C_3$ hydrocarbon feedstock and section 9 of the riser reactor. The resulting mixture of reaction products, unconverted feedstock, and catalyst passes upwardly through successive contiguous sections 10, 11, and 12 of riser reactor 2. Each of sections 9, 10, and 11 has a larger cross-sectional area than the preceding section, the cross-sectional areas increasing in the direction of flow of reactants and catalyst. The resulting mixture of hydrocarbon vapors, gases and catalyst comprising reaction products from the reactor sections 9, 10, 11, and 12 discharge into separator 13 wherein catalyst is separated from the hydrocarbon gases and vapors. Separator 13, is situated within a closed vessel 15, and preferably comprises a cyclone type separator in which a rough separation, e.g., about 85 percent separation of catalyst from hydrocarbon vapors is effected.

Catalyst and gaseous hydrocarbons discharged from the initial, relatively small diameter section 9 of riser reactor 2 into the larger diameter reactor section 10 are contacted with a normally liquid hydrocarbon fraction, introduced through line 14. In this example, fresh feed naphtha, i.e. a virgin naphtha fraction from crude oil, is introduced through line 14 into the lower part of section 10, where it comes into contact with the hot catalyst and gaseous hydrocarbons from reactor section 9. The combination of high temperature and short residence time in section 9 favors high yields of light olefins in the reaction products from section 9. Similarly, the combination of high temperature gaseous diluent, and short residence time in section 10 combine to favor high yields of gaseous olefins, especially $C_2$ and $C_3$ olefins from the naphtha cracking feedstock in section 10. The catalyst and reaction product from sections 9 and 10 flow upwardly through riser reactor 2 into section 11 which is of relatively larger diameter than section 10. Additional hydrocarbon charge stock is introduced into the lower part of section 11 through line 16. In this specific example, a raffinate naphtha resulting from solvent extraction of a naphtha fraction produced in the FCCU is introduced through line 16 into the lower part of section 11. As is known in the art, solvent extraction of a cracked naphtha produces an aromatic extract and a paraffinic raffinate. The raffinate naphtha is a preferred charge stock for the production of light olefins. Preferably, both the fresh naphtha introduced into section 10 through line 14 and the raffinate naphtha introduced into section 11 through line 16 are preheated to a temperature in the range of 900° to 1000° F. prior to introduction to the reactor. The raffinate naphtha feed may be combined with the fresh naphtha feed if desired. The initial reaction temperature in sections 10 and 11 are within the range of 1050° to 1200° F., e.g., 1150° to 1200° F. in section 10 and 1050° to 1150° F. in section 11. Preferred residence times for fresh and raffinate naphtha are within the range of 0.5 to 3 seconds.

The dispersion of catalyst in hydrocarbon vapors flowing upwardly from sections 9, 10, and 11, into a further enlarged section 12 of reactor 2 is contacted with a heavy cycle gas oil or bottoms fraction obtained by fractional distillation of the products of the FCCU. The heavy cycle gas oil, preferably preheated to a temperature in the range of 900° to 1000° F., is introduced into the lower part of section 12 through line 17. The initial reaction temperature in reactor section 12 is preferably in the range of 1050° F. to 1200° F. and the residence time in section 12 is preferably in the range of 0.5 to 3 seconds.

In each of reactor sections 9, 10, 11, and 12, reactions conditions suitable for substantially optimum conversion of the various hydrocarbon feedstreams introduced into the successive sections of the riser reactor to desired products may be obtained by variations in vapor velocity, catalyst loading, feed preheats, and regenerator temperature. The length and diameter of the various sections of reactor 2 are proportioned to maintain a desired reaction time in each section.

As the products leave the upper or discharge end of section 12 of riser reactor 2, the catalyst and reaction products are immediately separated from one another effectively quenching the conversion reactions.

Multipoint injection of normally liquid hydrocarbon cracking feedstocks into a transport reactor is known in the art, e.g. U.S. Pat. No. 3,042,196. Tapered riser reactors are known in the art as shown, for example in U.S. Pat. No. 3,661,799.

As a specific example of other preferred reaction conditions in the riser reactors, the catalyst-to-oil weight ratio in section 9 is in the range of from about 5 to about 10 and the weight hourly space velocity is in the range of about 50 to 100. In this particular example, a vapor velocity of 60 feet per second in section 9 of riser reactor 2 provides a residence time of the propane feedstock of approximately about 0.1 second. The vapor velocities in sections 10 and 11 of reactor 2 are preferably such that the average residence time of the fresh naphtha feed is within the range of 0.5 to 3 seconds. The average residence time of the raffinate naphtha in section 11 is preferably in the range of 0.5 to 1.5 seconds. Substantial conversion of fresh feed and recycle naphtha to low molecular weight olefins occurs in section 10 of reactor 2.

Conversion of heavy cycle gas oil to lower molecular weight products in section 12 of reactor 2 also results in a relatively large increase in the coke content of the spent catalyst discharged from reactor 21. Thus the amount of coke laid down on the catalyst may be conveniently controlled by regulating the quantity of heavy cycle gas oil introduced to reactor 21 through line 17. The burning of coke from the catalyst in the regenerator, as described hereinafter, supplies heat for the hydrocarbon conversion reactions taking place in reactors 2 and 20. It will be evident to those skilled in the art that by regulating the amount of heavy cycle gas oil introduced through line 17 to reactor 21, the temperature of the regenerated catalyst supplied from regenerator 5 to reactors 2 and 20 may be controlled within the desired temperature range.

In this specific embodiment of this invention, a second riser reactor 20 is provided for further conversion of naphtha feedstock and recycle fractions to light olefins. Various fractions of the FCCU products may be separated according to their boiling ranges in suitable fractionation equipment, not illustrated in the drawing, as is known in the art. In this specific example, a normally gaseous hydrocarbon charge stock is introduced into the lower part of section 24 or reactor 20 through line 25. In this specific embodiment, the hydrocarbon charge stock supplied through line 25 consists essentially of ethane, preferably an ethane recycle stream, i.e. a paraffinic $C_2$ or ethane-rich fraction obtained from the reaction products of the FCCU. The ethane-rich charge stock is preferably preheated to a temperature in the range of 900° to 1000° F.

Hot freshly regenerated catalyst is withdrawn from regenerator 5 through standpipe 21 as controlled by valve 22 and introduced into the lower part of the lowermost section 24 of riser reactor 20. The initial reaction temperature in section 24 is within the range of 1300° to 1425° F., preferably about 1375° F., and the residence time in section 24 is in the range of 0.1 to 1 second, preferably 0.2 to 0.5 second.

The resulting mixture of gasiform hydrocarbons and catalyst suspended therein passes upwardly through section 24 of riser reactor 20, suitably at an average superficial gas velocity within the range of from about 50 to about 100 feet per second. Conversion of the $C_2$ hydrocarbon feedstock to ethylene takes place primarily in section 24 of the reactor. The combination of high temperature and short residence time in section 24 favors high yields of ethylene.

The resulting mixture of reaction products, unconverted feedstock, and catalyst passes upwardly through successive contiguous sections 27, 28 and 29 of reactor 20. Each of sections 27, 28 and 29 has a larger cross-sectional area than the preceding section, the cross-sectional areas or reactor section diameters increasing in the direction of flow of reactants and catalyst upwardly through the reactor.

Catalyst and gaseous hydrocarbons discharged from the initial, relatively small diameter section 24 of riser reactor 20 into the larger diameter section 27 of the reactor are contacted with a second hydrocarbon feedstock introduced through line 30 into the lower part of section 27. In this particular embodiment, a butane rich feedstock is introduced to line 30, for example a paraffinic $C_4$ fraction recovered from the FCCU reactor products. The butane-rich feedstock introduced through line 30 comes into contact with hot catalyst and gaseous hydrocarbons from section 24 of the reactor. The initial reactor temperature in section 27 preferably is in the range of 1200° to 1300° F. with a preferred residence time in the range of 0.2 to 1 second. The combination of high temperature, gaseous diluents, and short residence time in section 27 of the reactor combine to favor high yields of gaseous olefins including $C_2$ to $C_4$ olefins.

The catalyst and reaction products from sections 24 and 27 are, in turn, discharged into section 28 which is of relatively larger diameter than section 27. Additional hydrocarbon charge stock is introduced into the lower part of section 28 through line 31. In this specific embodiment, a recycle naphtha fraction of the products from the FCCU is supplied to the reactor through line 31. Preferably, both the $C_4$ feedstock introduced through line 30 and the recycle naphtha introduced through line 31 are preheated to a temperature in the range of 900° to 1000° F. prior to introduction to the reactor. The initial reaction temperature in section 28 is preferably in the range of 1050° to 1200° F., with preferred residence time in the range of 0.5 to 1.5 second.

The dispersion of catalyst in hydrocarbon vapors passing upwardly from sections 24, 27 and 28 into section 29 of reactor 20, which is larger in diameter than section 28, is contacted with a part of the fresh naphtha feedstock entering the lower part of section 29 through line 32. The fresh naphtha feedstock is preferably preheated to a temperature in the range of 900° to 1000° F. The preferred initial reaction temperature in section 29 of reactor 20 is within the range of 1050° to 1200° F. and the residence time in section 29 of reactor 20 is preferably in the range of 0.5 to 3 seconds.

In this particular preferred embodiment, the catalyst-to-oil weight ratio in section 24 is in the range of from about 5 to about 10 and the weight hourly space velocity is in the range of about 50 to 100. In this embodiment, a vapor velocity of 60 feet per second in section 24 of riser section 20 provides a residence time of approximately 0.5 second. The vapor velocities in sections 27 and 28 are preferably such that the average residence time of the hydrocarbons in section 27 is in the range of 0.2 to 1 second and the average residence time in section 28 is in the range of 0.5 to 3 seconds.

The resulting mixture of hydrocarbon vapors, gases and catalyst comprising reaction products from sections 24, 27, 28 and 29 of reactor 20 are discharged into separator 33 wherein catalyst is separated from the hydrocarbon gases and vapors. Separator 33 preferably comprises a cyclone type separator in which a rough separation between catalyst and hydrocarbon gases and vapors takes place. Catalyst separated from the vapors and gases in separators 13 and 33 is introduced into fluidized bed 35 of catalyst in the lower part of vessel 15. The fluidized bed 35 of catalyst has an upper level 36 below cyclone separators 13 and 33. The hydrocarbon vapors, still containing some entrained catalyst, are discharged from separators 13 and 33 through outlets 37 and 38, respectively, into the dilute phase upper section of reactor-separator vessel 15 wherein a further separation of entrained catalyst from hydrocarbon vapors takes place.

Products of the cracking reaction pass upwardly through the dilute phase section of vessel 15, above the upper surface 36 of the catalyst bed, into cyclone separator 40 wherein entrained catalyst is separated from the vapors. The separated catalyst is returned to the fluidized bed of catalyst 35 through dipleg 41. Fuel gas is introduced into the lower part of catalyst bed 35 from line 42 to distributor ring 43.

Although a single cyclone separator 40 is illustrated, it is customary to provide several cyclone separators in series to achieve substantially complete separation of catalyst from vapors and gases leaving the reactor. As is well known in the art, a plurality of such assemblies may be employed in large reactors. Effluent vapors and gases pass from cyclone separator 40 through line 44 to plenum chamber 45 wherein the vapors and gases from other cyclone separator assemblies, not illustrated, are collected and discharged from the reactor through line 46. Recycle naphtha may be injected into vapor line 46 through line 47 to maintain the temperature in line 46 at a level not exceeding about 950° F. Vapor line 46 conveys reaction products to fractionation facilities, not illustrated, wherein the converted products are recovered and separated into desired product and recycle streams by condensation, absorption and distillation facilities well known in the art.

The dense phase fluidized bed of catalyst 35 in the lower portion of reactor-separator vessel 15 passes downwardly through slide valves 47 and 48 into a catalyst stripping zone 50, Stripping zone 50 is provided with baffles 51 and 52 of known type. Stripping steam is introduced into stripping zone 50 through line 53 and steam distributor ring 54. Steam rising through the catalyst in stripping zone 50 displaces and removes absorbed, and entrained hydrocarbons from the catalyst. Fuel gas is introduced through line 55 and distributor ring 56 into the lower part of stripping zone 56 as a supplemental stripping medium. Stripping steam and stripped hydrocarbons are discharged from the stripper into the upper portion of reactor-separator vessel 15.

Stripped catalyst is withdrawn from the bottom of stripper 50 through spent catalyst standpipe 57 at a rate controlled by slide valve 58 into a dense phase fluidized bed of catalyst 60 in regenerator 5. In regenerator 5, stripped spent catalyst is contacted with air introduced through line 61 and air distributor ring 62 into the lower portion of the dense phase bed of catalyst. The dense phase fluidized bed of catalyst undergoing regeneration in regenerator 5 bed has an upper surface 64, where flue gases resulting from regeneration of the catalyst with air are disengaged from the dense phase fluidized bed 60. Above the upper surface 64, further separation of catalyst from flue gases take place in the dilute phase section of catalyst regenerator 5. Sufficient air is introduced into the regenerator through line 61 for complete combustion of all of the carbonaceous material from the catalyst undergoing regeneration. Fuel gas may be supplied to the lower portion of catalyst bed 60 from line 72 and distributor ring 74 to supplement the coke on the catalyst as a source of heat for maintaining the temperature of the regenerated catalyst at the desired level within the range of 1375° to 1450° F.

The resulting flue gases pass upwardly from the dense phase bed of catalyst into the dilute phase section of the catalyst regenerator 5 and enter cyclone separator 65 wherein entrained catalyst is separated from the flue gases and returned to the dense phase fluidized bed of catalyst 64 through dip leg 66. Cyclone separator 65, although represented diagrammatically as a single unit, may comprise an assembly of cyclone separators arranged in parallel and in series, as in reactor-separator vessel 15, to effect substantially complete separation of entrained solids from the flue gas.

Effluent flue gas from cyclone separator 65 is passed through line 67 into the plenum chamber 68 and through flue line 70 to vent facilities, not illustrated. The flue gas discharged from regenerator 5 through line 70 consists essentially of nitrogen and carbon dioxide admixed with relatively small amounts of oxygen. Typically, the regenerator flue gas comprises about 81 to 88 percent nitrogen, 10 to 16 percent carbon dioxide, 2 to 5 percent oxygen, and trace amounts, i.e. less than 100 ppm, of carbon monoxide. Various means for recovering heat energy from the hot flue gases prior to discharge to the atmosphere, such as generation of steam or expansion through gas turbines with the generation of power, are well known in the art.

Catalyst separated from the hydrocarbon vapors in separators 13 and 33 flows downwardly into the catalyst bed in stripper 50 through catalyst diplegs 76 and 78, each provided at its lower end with a suitable gas seal such as the known J-seal illustrated. Steam and hydrocarbon gases and vapors containing entrained catalyst are discharged from stripping zone 50 through line 79 to cyclone separator 80 in the reactor-separator section of vessel 15. Catalyst separated from the gases and vapors in cyclone separator 80 is returned to the fluidized bed of catalyst 35 through dip leg 41. Gases and vapors from separator 80 are discharged through line 82 to plenum chamber 45 to line 46. Cyclone separator 80, although represented diagrammatically as a single unit, may comprise an assembly of cyclone separators, as already described.

Hot regenerated catalyst is withdrawn from the bottom of regenerator 5 through lines 6 and 21 at rates controlled by slide valves 7 and 22 to supply hot regenerated catalyst to riser reactors 2 and 20, respectively, as described hereinabove.

From the above detailed description of the process and apparatus of this invention, many advantages of this invention will be apparent to persons skilled in the art.

We claim:

1. A process for the production of normally gaseous olefins from a hydrocarbon feedstock in a transport type fluid catalytic cracking reaction zone in the presence of a zeolite catalyst in which fresh feedstock is brought into contact with hot regenerated catalyst in a riser reaction zone, which comprises charging heavy hydrocarbon charge stock to an upper section of a riser reaction zone near its discharge end, charging a normally gaseous $C_2$ to $C_3$ rich paraffinic charge stock into the lowermost portion of said riser reaction zone into contact with hot freshly regenerated catalyst and introducing a paraffinic normally liquid naphtha or gas oil into a section of said riser reaction zone intermediate said lower and upper sections of said riser reaction zone.

2. A process according to claim 1 wherein said naphtha fraction is a virgin naphtha.

3. A process according to claim 1 wherein said naphtha fraction is a raffinate naphtha.

4. A process for the production of normally gaseous olefins from a virgin hydrocarbon feedstock in a transport type fluid catalytic cracking reaction zone in the presence of a zeolite catalyst in which fresh feedstock is brought into contact with hot regenerated catalyst in a riser reaction zone, which comprises charging said fresh charge stock to an upper section of a riser reaction zone near its discharge end, charging a normally gaseous $C_2$ to $C_3$ rich paraffinic charge stock into the lowermost portion of said riser reaction zone into contact with hot freshly regenerated catalyst and introducing a recycle naphtha or gas oil separated from the products from said cracking reaction into a section of said riser reaction zone intermediate said lower and upper sections of said riser reaction zone.

5. A process according to claim 4 in which a heavy cycle gas oil fraction is subjected to cracking reaction conditions in a second separate riser reaction zone wherein said heavy cycle gas oil is charged to an upper section of said second riser reaction zone, a propane-rich gas is admixed with fresh hot regenerated catalyst at the lowermost section of said second riser reaction zone, and a naphtha fraction is added to the mixture of catalyst and propane and its reaction products in a section of said second riser reaction zone intermediate said upper and lowermost sections of said second riser reaction zone.

6. The process of claim 4 wherein the initial reaction temperature in the lowermost section of said riser reactor is maintained within the range of 1200° to 1375° F.

7. A process according to claim 4 wherein a paraffinic $C_4$ hydrocarbon charge stock is introduced into a section of said reactor intermediate said upper and lowermost sections.

8. A process according to claim 4 wherein catalyst is separated from the effluent of said riser reactor, stripped with steam in a spent catalyst stripping zone, and regenerated in a catalyst regenration zone wherein a dense phase fluidized bed of catalyst comprising coke-contaminated spent catalyst is contacted with an oxygen-containing regeneration gas in an amount in excess of the amount theoretically required for complete combustion of coke to fully oxidized reaction products at a temperature in the range of 1375° to 1450° F. effecting substantially complete removal of coke from said catalyst, separating resulting flue gases from hot freshly regenerated catalyst, and contacting said hot freshly regenerated catalyst at a temperature in the range of 1375° F. to 1450° F. with said gaseous hydrocarbon charge stock.

9. A process according to claim 8 wherein oxygen is supplied to said regeneration zone in an amount sufficient to maintain an oxygen concentration in the range of 2 to 5 mole percent in said flue gas.

10. The process of claim 4 wherein the residual carbon on said hot regenerated catalyst is maintained within the range of from about 0.01 to about 0.10 weight percent.

11. The process of claim 4 wherein each of said hydrocarbon feedstocks is preheated to a temperature in the range of 900° to 1000° F.

* * * * *